US011238810B2

(12) United States Patent
Kim et al.

(10) Patent No.: US 11,238,810 B2
(45) Date of Patent: Feb. 1, 2022

(54) DISPLAY APPARATUS AND METHOD OF DRIVING DISPLAY PANEL USING THE SAME

(71) Applicant: Samsung Display Co., Ltd., Yongin-Si (KR)

(72) Inventors: HongSoo Kim, Hwaseong-si (KR); Sangan Kwon, Cheonan-si (KR); Jinyoung Roh, Hwaseong-si (KR); Sehyuk Park, Seongnam-si (KR); Sukhun Lee, Suwon-si (KR); Hyojin Lee, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/923,477

(22) Filed: Jul. 8, 2020

(65) Prior Publication Data

US 2021/0027715 A1 Jan. 28, 2021

(30) Foreign Application Priority Data

Jul. 26, 2019 (KR) ..... 10-2019-0091095

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0221* (2013.01);
(Continued)

(58) Field of Classification Search
CPC ... G09G 2340/0435; G09G 2320/0247; G09G 2320/0257; G09G 5/391
See application file for complete search history.

(56) References Cited

U.S. PATENT DOCUMENTS 9,524,694 B2 12/2016 Wang et al.
2006/0152620 A1* 7/2006 Morita ..... H04N 7/012 348/448

(Continued)

FOREIGN PATENT DOCUMENTS

EP 2711919 A1 3/2014
KR 1020150094881 A 8/2015

(Continued)

OTHER PUBLICATIONS

Extended European Search Report for Application No. 20188006.9-1209 dated Dec. 4, 2020.

*Primary Examiner* — Gerald Johnson
(74) *Attorney, Agent, or Firm* — Cantor Colburn LLP

(57) ABSTRACT

A display apparatus includes a display panel, a gate driver, a data driver and a driving controller. The display panel displays an image based on input image data. The gate driver outputs a gate signal to a gate line of the display panel. The data driver outputs a data voltage to a data line of the display panel. The driving controller controls operations of the gate driver and the data driver and drive a still image display area and a video image display area of a display area of the display panel in different driving frequencies. The driving controller includes a still image determiner which divides the input image data into a plurality of still image determining blocks, respectively determines whether the still image determining blocks represent a still image or a video image and determines a boundary between the still image display area and the video image display area.

20 Claims, 11 Drawing Sheets

(52) U.S. Cl.
CPC ..... *G09G 2320/0247* (2013.01); *G09G 2320/103* (2013.01); *G09G 2330/023* (2013.01)

(56) References Cited

U.S. PATENT DOCUMENTS

| | | | | |
|---|---|---|---|---|
| 2008/0284702 | A1* | 11/2008 | Shidara | G09G 3/20 345/90 |
| 2010/0007670 | A1* | 1/2010 | Song | G09G 3/3426 345/522 |
| 2014/0092145 | A1 | 4/2014 | Park et al. | |
| 2015/0170607 | A1* | 6/2015 | Shin | G09G 3/3406 345/690 |
| 2015/0340014 | A1* | 11/2015 | Kim | G09G 5/18 345/212 |
| 2016/0035260 | A1* | 2/2016 | Kim | G09G 3/3614 345/212 |
| 2016/0042708 | A1 | 2/2016 | Wang et al. | |
| 2016/0111055 | A1 | 4/2016 | Na et al. | |
| 2017/0132964 | A1* | 5/2017 | Lee | G09G 5/18 |

FOREIGN PATENT DOCUMENTS

| | | | |
|---|---|---|---|
| KR | 1020170060662 | A | 6/2017 |
| KR | 101965079 | B1 | 4/2019 |

* cited by examiner

FIG. 9

| STAGE | INPUT GRAYSCALE VALUE(8bit) | FLICKER VALUE | FREQUENCY(Hz) |
|---|---|---|---|
| 1 | 0-3 | 0 | 1 |
| 2 | 4-7 | 0 | 1 |
| 3 | 8-11 | 40 | 2 |
| 4 | 12-15 | 80 | 5 |
| 5 | 16-19 | 120 | 10 |
| 6 | 20-23 | 160 | 30 |
| 7 | 24-27 | 200 | 60 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

DISPLAY APPARATUS AND METHOD OF DRIVING DISPLAY PANEL USING THE SAME

This application claims priority to Korean Patent Application No. 10-2019-0091095, filed on Jul. 26, 2019, and all the benefits accruing therefrom under 35 U.S.C. § 119, the content of which in its entirety is herein incorporated by reference.

BACKGROUND

1. Field

Exemplary embodiments of the invention relate to a display apparatus and a method of driving a display panel of the display apparatus. More particularly, exemplary embodiments of the invention relate to a display apparatus with reduced power consumption and a method of driving a display panel of the display apparatus.

2. Description of the Related Art

A method to minimize a power consumption of a portable electronic device such as a tablet personal computer ("PC") and a laptop computer have been studied.

To minimize the power consumption of the portable electronic device which typically includes a display panel, a power consumption of the display panel may be minimized. When the display panel displays a still image, the display panel may be driven in a relatively low frequency so that a power consumption of the display panel may be reduced.

SUMMARY

When a portion of a display panel of an electronic device displays a video image and another portion of the display panel displays a still image, the display panel may be driven by a relatively high frequency so that the power consumption of the display panel may not be effectively reduced.

In addition, when the display panel is driven in the relatively low frequency, a flicker may occur so that a display quality may decrease.

Exemplary embodiments of the invention provide a display apparatus with reduced power consumption and enhanced display quality.

Exemplary embodiments of the invention also provide a method of driving a display panel of the display apparatus.

In an exemplary embodiment of a display apparatus according to the invention, the display apparatus includes a display panel, a gate driver, a data driver and a driving controller. In such an embodiment, the display panel includes a gate line, a data line and a pixel, and the display panel displays an image based on input image data. In such an embodiment, the gate driver outputs a gate signal to the gate line, the data driver outputs a data voltage to the data line, and the driving controller controls an operation of the gate driver and an operation of the data driver and drive a still image display area and a video image display area of a display area of the display panel in different driving frequencies. In such an embodiment, the driving controller includes a still image determiner which divides the input image data into a plurality of still image determining blocks, respectively determines whether the still image determining blocks represent a still image or a video image and determines a boundary between the still image display area and the video image display area.

In an exemplary embodiment, the still image determiner may be which generates a flag signal representing whether the still image determining blocks represent the still image or the video image.

In an exemplary embodiment, the driving controller may further include a driving frequency determiner which divides the still image display area into a plurality of driving frequency determining blocks and respectively determines driving frequencies of the driving frequency determining blocks based on a flicker value corresponding to a grayscale value of the input image data for the driving frequency determining blocks.

In an exemplary embodiment, a size of the still image determining block may be different from a size of the driving frequency determining block.

In an exemplary embodiment, the size of the still image determining block may be less than the size of the driving frequency determining block.

In an exemplary embodiment, the size of the driving frequency determining block may be fixed independently of the size of the still image display area. In such an embodiment, when the size of the still image display area increases according to the input image data, a number of the driving frequency determining blocks may increase.

In an exemplary embodiment, a number of the driving frequency determining blocks may be fixed independently of the size of the still image display area. In such an embodiment, when the size of the still image display area increases according to the input image data, the size of the driving frequency determining block may increase.

In an exemplary embodiment, the driving controller may further include a fixed frequency determiner which determines whether an input frequency of the input image data has a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

In an exemplary embodiment, the fixed frequency determiner may generate a frequency flag representing whether the input frequency of the input image data has the normal type or not. In such an embodiment, the driving frequency determiner may determine a driving frequency of the display panel.

In an exemplary embodiment, the driving controller may further include a compensation frame inserter which inserts a compensation frame between a frame of a first frequency and a frame of a second frequency when the driving frequencies of the driving frequency determining blocks are changed from the first frequency to the second frequency by the driving frequency determiner.

In an exemplary embodiment, the display panel may include a plurality of segments. The driving controller may determine a driving frequency of the first display panel based on driving frequencies determined based on a flicker value corresponding to a grayscale value of the input image data for the segments.

In an exemplary embodiment, each of the driving frequency determining blocks may include a plurality of the segments. In such an embodiment, the driving frequency determiner may determine the driving frequency of each of the driving frequency determining block based on driving frequencies determined based on a flicker value corresponding to a grayscale value of the input image data for the segments therein.

In an exemplary embodiment of a method of driving a display panel, the method includes dividing input image data into a plurality of still image determining blocks, respectively determining whether the still image determining blocks represent a still image or a video image, determining a boundary between a still image display area and a video image display area of a display area of the display panel, determining a driving frequency of the still image display area, determining a driving frequency of the video image display area, outputting a gate signal to a gate line of the display panel based on the driving frequency of the still image display area and the driving frequency of the video image display area and outputting a data voltage to a data line of the display panel based on the driving frequency of the still image display area and the driving frequency of the video image display area. In such an embodiment, the still image display area and the video image display area of the display area may be driven in different driving frequencies from each other.

In an exemplary embodiment, the method may further include generating a flag signal representing whether the still image determining blocks represent the still image or the video image.

In an exemplary embodiment, the method may further include dividing the still image display area into a plurality of driving frequency determining blocks and respectively determining driving frequencies of the driving frequency determining blocks based on a flicker value corresponding to a grayscale value of the input image data for the driving frequency determining blocks.

In an exemplary embodiment, a size of the still image determining block may be less than a size of the driving frequency determining block.

In an exemplary embodiment, the method may further include inserting a compensation frame between a frame of a first frequency and a frame of a second frequency when the driving frequencies of the driving frequency determining blocks are changed from the first frequency to the second frequency.

In an exemplary embodiment, each of the driving frequency determining blocks may include a plurality of segments. In such an embodiment, the driving frequency of each of the driving frequency determining blocks may be determined based on driving frequencies determined based on the flicker value corresponding to the grayscale value of the input image data for the segments therein.

In an exemplary embodiment, the method may further include determining whether an input frequency of the input image data is a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

In an exemplary embodiment, the method may further include generating a frequency flag representing whether the input frequency of the input image data has the normal type or not. In such an embodiment, the driving frequency of the still image display area may be determined based on the frequency flag.

According to exemplary embodiments of the method of driving the display panel and the display apparatus including the display panel, the driving frequency is determined based on an image displayed on the display panel so that a power consumption of the display apparatus may be reduced. In such embodiments, when the input image data include a still image display area and a video image display area, the still image display area and the video image display area may be driven in different frequencies from each other so that the power consumption of the display apparatus may be further reduced.

In exemplary embodiments, the still image determiner may divide the input image data into a plurality of still image determining blocks and determine whether each of the still image determining blocks represents a still image or a video image to determine a boundary between the still image display area and the video image display area so that the power consumption of the display apparatus may be further reduced.

In exemplary embodiments, the driving frequency determiner may divide the still image display area into a plurality of driving frequency determining blocks and respectively determine driving frequencies of the driving frequency determining blocks based on the flicker value corresponding to the grayscale value of the input image data therefor so that the power consumption of the display apparatus may be further reduced.

BRIEF DESCRIPTION OF THE DRAWINGS

The above and other features of the invention will become more apparent by describing in detailed exemplary embodiments thereof with reference to the accompanying drawings, in which:

FIG. 9 is a table illustrating values of a flicker value storage of FIG. 2;

DETAILED DESCRIPTION

Figure 1:
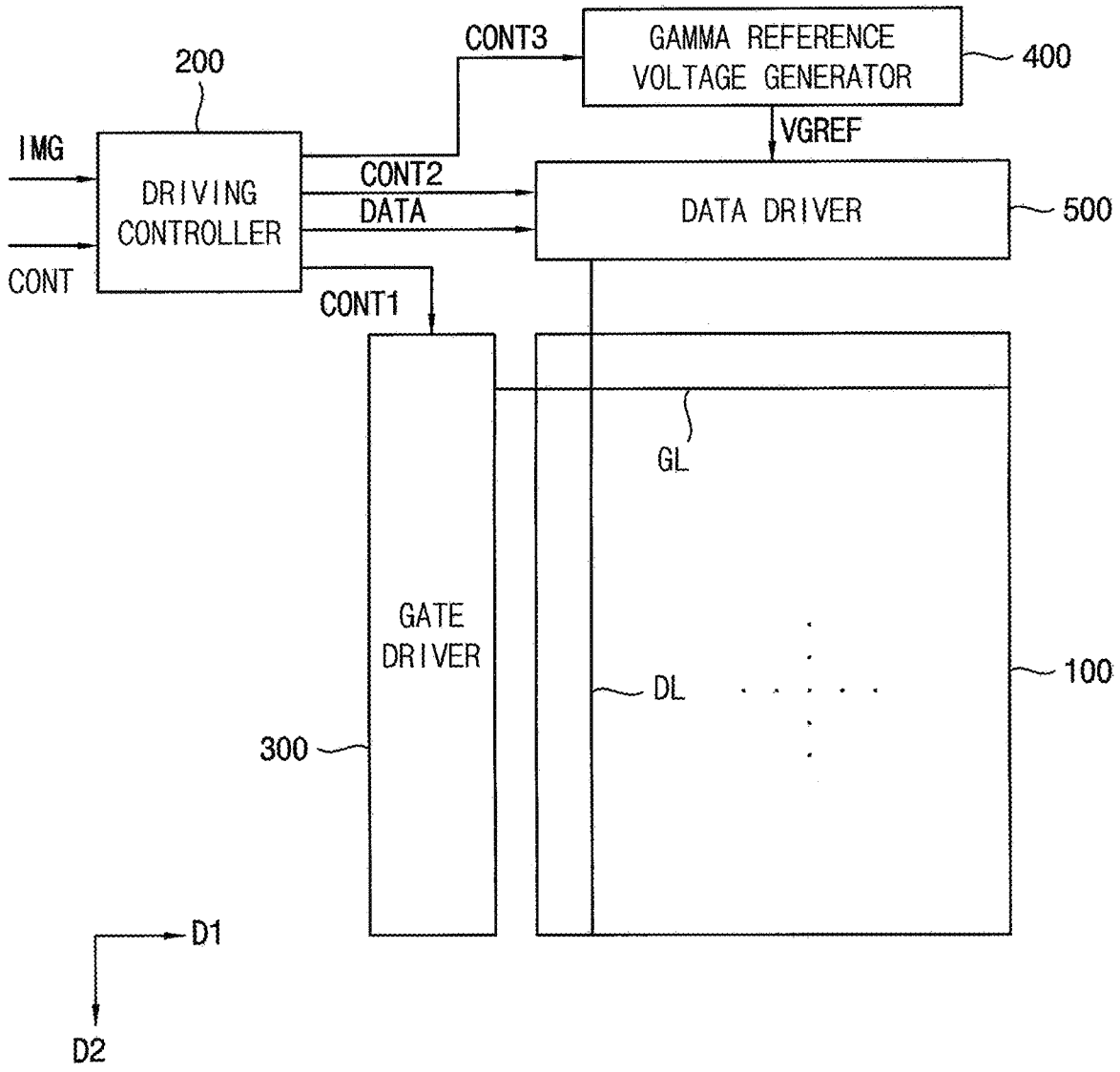
FIG. 1 is a block diagram illustrating a display apparatus according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. Expressions such as "at least one of," when preceding a list of elements, modify the entire list elements and do not modify the individual elements of the list. For example, the expression "at least one of a, b or c" indicates only a, only b, only c, both a and b, both a and c, both b and c, all of a, b, and c, or variations thereof.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, exemplary embodiments of the invention will be described in detail with reference to the accompanying drawings.

FIG. 1 is a block diagram illustrating a display apparatus according to an exemplary embodiment of the invention.

Referring to FIG. 1, an exemplary embodiment of the display apparatus includes a display panel 100 and a display panel driver. The display panel driver includes a driving controller 200, a gate driver 300, a gamma reference voltage generator 400 and a data driver 500.

In one exemplary embodiment, for example, the driving controller 200 and the data driver 500 may be integrally formed, e.g., as a single integrated circuit. In one exemplary embodiment, for example, the driving controller 200, the gamma reference voltage generator 400 and the data driver 500 may be integrally formed, e.g., as a single integrated circuit. A driving module including at least the driving controller 200 and the data driver 500, which are integrally formed, may be referred to as a timing controller embedded data driver ("TED").

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

In one exemplary embodiment, for example, the display panel 100 may be an organic light emitting display panel including an organic light emitting element.

The display panel 100 may be driven in a normal driving mode, in which the display panel 100 is driven in a normal driving frequency, and in a low frequency driving mode, in which the display panel 100 is driven in a frequency less than the normal driving frequency.

In one exemplary embodiment, for example, when the input image data represent a video image, the display panel 100 may be driven in the normal driving mode. In one exemplary embodiment, for example, when the input image data represent a still image, the display panel may be driven in the low frequency driving mode. In one exemplary embodiment, for example, when the display apparatus is operated in the always-on mode, the display panel may be driven in the low frequency driving mode.

In such an embodiment, a portion of the input image data representing a video image may be driven in the normal driving mode and another portion of the input image data representing a still image may be driven in the low frequency driving mode.

The display panel 100 may be driven in a unit of frame. The display panel 100 may be refreshed in every frame in the normal driving mode. Thus, the normal driving mode includes only writing frames in which the data is written in the pixel.

The display panel 100 may be refreshed in the frequency of the low frequency driving mode in the low frequency driving mode. Thus, the low frequency driving mode includes the writing frames, in which the data is written in the pixel, and holding frames, in which the written data is maintained without writing the data in the pixel.

The driving controller 200 receives input image data IMG and an input control signal CONT from an external apparatus (not shown). In an exemplary embodiment, the input image data IMG may include red image data, green image data and blue image data, for example. The input image data IMG may further include white image data. Alternatively, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

In one exemplary embodiment, for example, the driving controller 200 may adjust a driving frequency of the display panel 100 based on the input image data IMG.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 will be described later in detail referring to FIGS. 2 to 11.

The gate driver 300 generates gate signals driving the gate lines GL in response to the first control signal CONT1 received from the driving controller 200. The gate driver 300 outputs the gate signals to the gate lines GL. In one exemplary embodiment, for example, the gate driver 300 may sequentially output the gate signals to the gate lines GL. In one exemplary embodiment, for example, the gate driver 300 may be mounted on the display panel 100. In one exemplary embodiment, for example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages of an analog type using the gamma reference voltages VGREF. The data driver 500 outputs the data voltages to the data lines DL.

Figure 2:
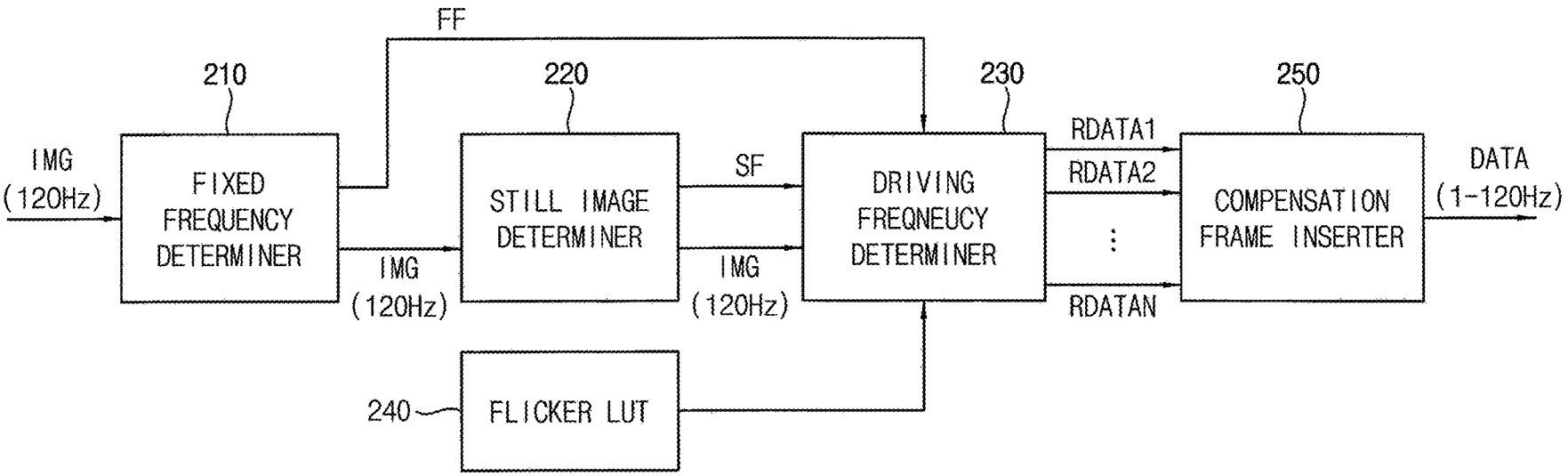
FIG. 2 is a block diagram illustrating a driving controller of FIG. 1.
Figure 3:
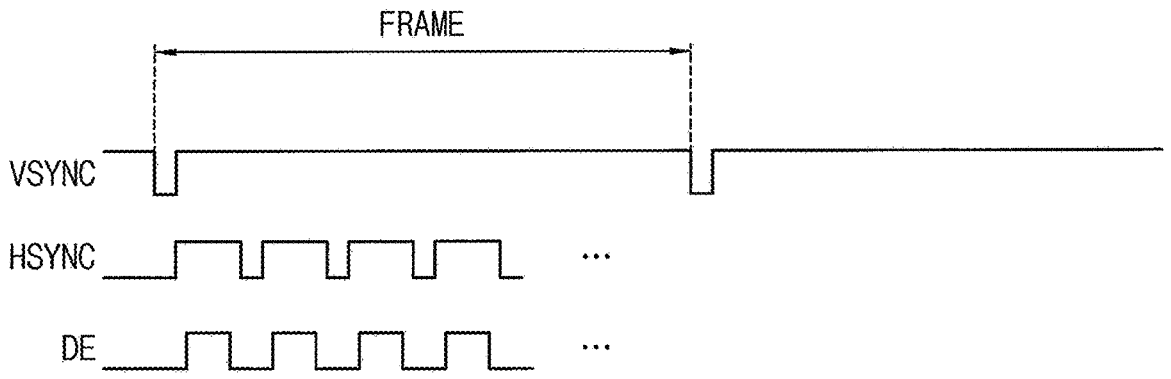
FIG. 3 is a timing diagram illustrating an operation of a fixed frequency determiner of FIG. 2.

FIG. 2 is a block diagram illustrating the driving controller 200 of FIG. 1. FIG. 3 is a timing diagram illustrating an operation of a fixed frequency determiner 210 of FIG. 2.

Referring to FIGS. 1 to 3, an exemplary embodiment of the driving controller 200 may include a still image determiner 220, a driving frequency determiner 230 and a flicker value storage 240. The driving controller 200 may further include the fixed frequency determiner 210. The driving controller 200 may further include a compensation frame inserter 250.

The fixed frequency determiner 210 may determine whether an input frequency of the input image data IMG is a normal type. In one exemplary embodiment, for example, the fixed frequency determiner 210 may determine whether the input frequency of the input image data IMG is the normal type by counting the number of pulses of a horizontal synchronizing signal HSYNC between a first pulse and a second pulse of a vertical synchronizing signal VSYNC or by counting the number of pulses of a data enable signal DE between the first pulse and the second pulse of the vertical synchronizing signal VSYNC.

A time duration between the first pulse and the second pulse of the vertical synchronizing signal VSYNC may be defined as one frame. When the input frequency of the input image data IMG is 120 hertz (Hz), the number of the pulses of the horizontal synchronizing signal HSYNC between the first pulse and the second pulse of the vertical synchronizing signal VSYNC may be 120. When the input frequency of the input image data IMG is 120 Hz, the number of the pulses of the data enable signal DE between the first pulse and the second pulse of the vertical synchronizing signal VSYNC may be 120.

When the number of the pulses of the horizontal synchronizing signal HSYNC or the number of the pulses of the data enable signal DE between the first pulse and the second pulse of the vertical synchronizing signal VSYNC is equal to the input frequency, the fixed frequency determiner 210 may determine that the input frequency of the input image data IMG is the normal type. When the number of the pulses of the horizontal synchronizing signal HSYNC or the number of the pulses of the data enable signal DE between the first pulse and the second pulse of the vertical synchronizing signal VSYNC is not equal to the input frequency, the fixed frequency determiner 210 may determine that the input frequency of the input image data IMG is not the normal type.

The fixed frequency determiner 210 may generate a frequency flag FF representing whether the input frequency of the input image data IMG is the normal type or not. The fixed frequency determiner 210 may output the frequency flag FF to the driving frequency determiner 230. The driving frequency determiner 230 may determine the driving frequency of the display panel 100 based on the frequency flag FF. In one exemplary embodiment, for example, when the input frequency of the input image data IMG does not have the normal type, the driving frequency determiner 230 may drive the switching elements in the pixel not in the low driving frequency but in the normal driving frequency (e.g. 120 Hz). When the input frequency of the input image data IMG does not have the normal type and the display panel 100 is driven in the low driving frequency, the display panel 100 may generate a display defect. In addition, the still image determiner 220 may not operate when the input frequency of the input image data IMG is not the normal type, because the driving frequency is fixed to the normal driving frequency when the input frequency of the input image data IMG is not the normal type.

Figure 4:
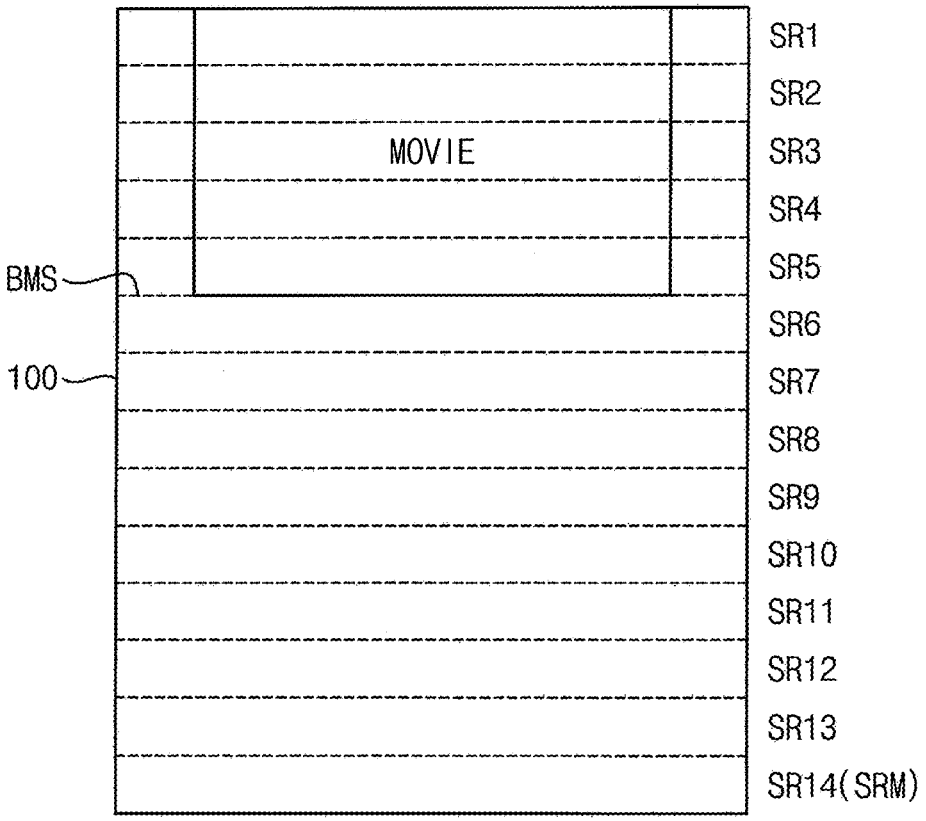
FIG. 4 is a conceptual diagram illustrating an operation of a still image determiner of FIG. 2.
Figure 5:
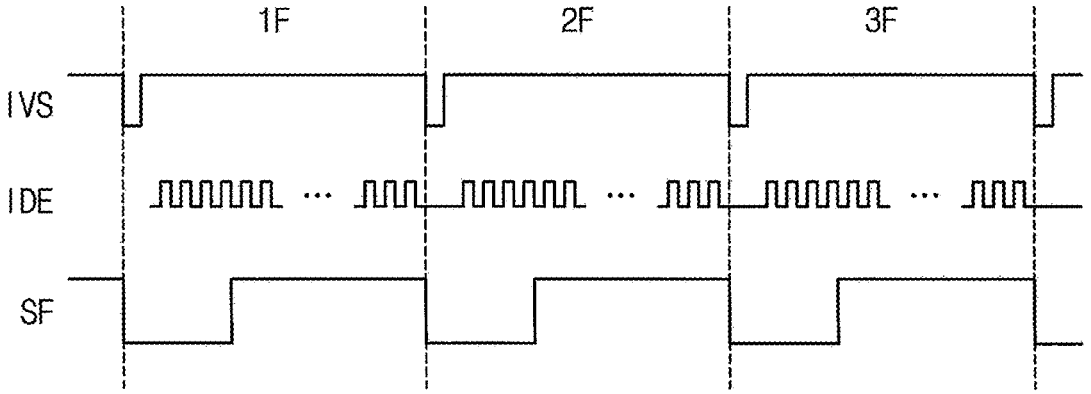
FIG. 5 is a signal timing diagram illustrating output signals of the still image determiner of FIG. 2.
Figure 6:
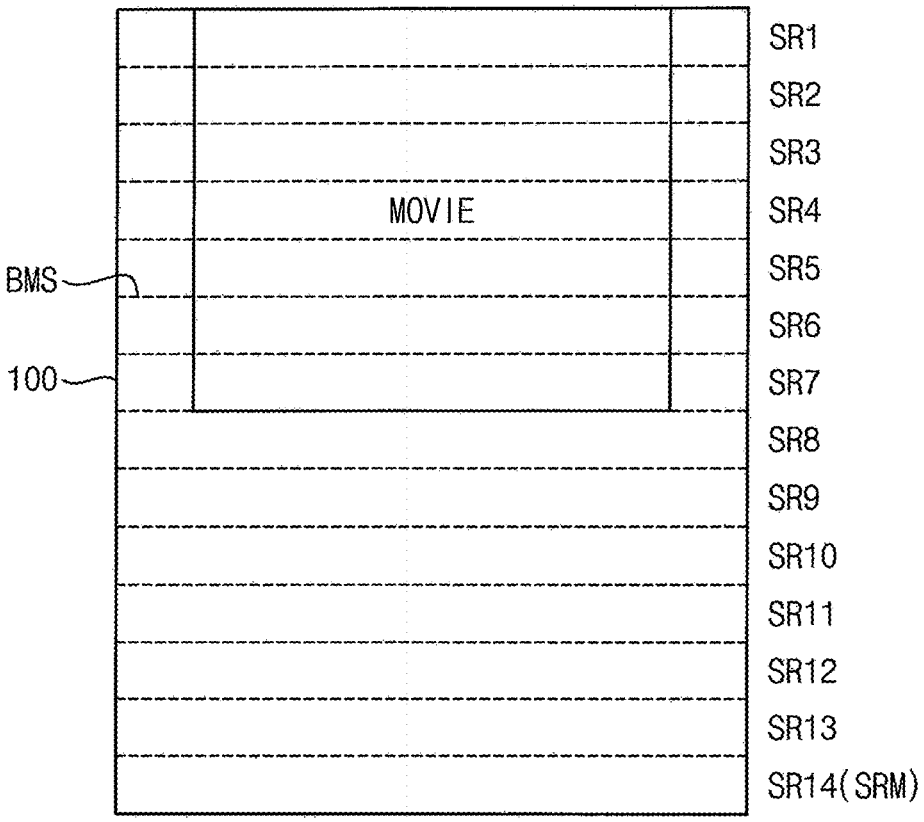
FIG. 6 is a conceptual diagram illustrating an operation of the still image determiner of FIG. 2.
Figure 7:
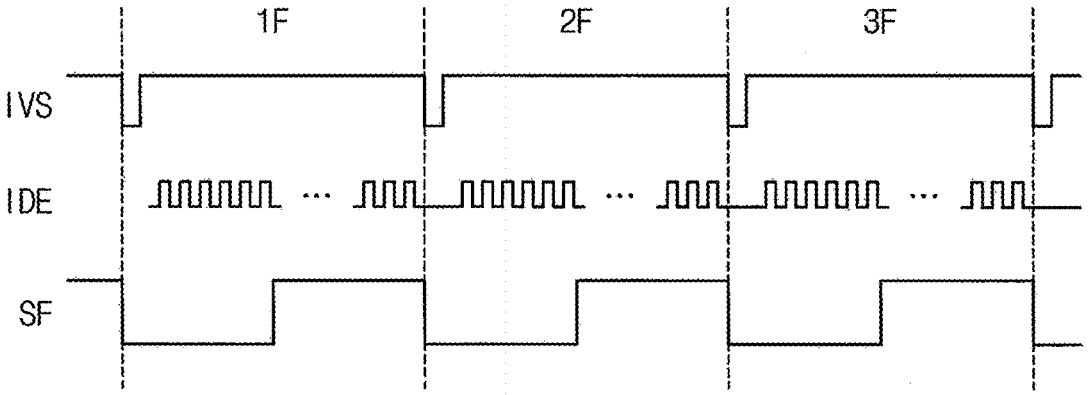
FIG. 7 is a signal timing diagram illustrating output signals of the still image determiner of FIG. 2.

FIG. 4 is a conceptual diagram illustrating an operation of the still image determiner 220 of FIG. 2. FIG. 5 is a signal timing diagram illustrating output signals of the still image determiner 220 of FIG. 2. FIG. 6 is a conceptual diagram illustrating an operation of the still image determiner 220 of FIG. 2. FIG. 7 is a signal timing diagram illustrating output signals of the still image determiner 220 of FIG. 2.

Referring to FIGS. 1 to 7, in an exemplary embodiment, the still image determiner 220 may divide the input image data IMG into a plurality of still image determining blocks SR1 to SRM. In one exemplary embodiment, for example, each of the still image determining blocks SR1 to SRM may extend in a direction perpendicular to a scanning direction (e.g. D2) of the gate signal. Each of the still image determining blocks SR1 to SRM may extend in the first direction D1.

In FIG. 4, the input image data IMG include fourteen still image determining blocks for convenience of illustration and description, but the invention is not be limited thereto.

The still image determiner 220 may determine whether each of the still image determining blocks SR1 to SR14 represents or displays a still image or a video image. The still image determiner 220 may determine a boundary BMS between a still image display area and a video image display area.

In an exemplary embodiment, as shown in FIG. 4, for example, first to fifth determining blocks SR1 to SR5 may represent video images, and sixth to fourteenth determining blocks SR6 to SR14 may represent still images.

The still image determiner 220 may generate a flag signal SF representing whether the still image determining blocks SR1 to SR14 represent the still image or the video image. The still image determiner 220 may output the flag signal SF to the driving frequency determiner 230. In one exemplary embodiment, for example, when the still image determining block represents the still image, the still image determiner 220 may output the flag signal SF having a value of 1 to the driving frequency determiner 230. When the still image determining block represents the video image, the still image determiner 220 may output the flag signal SF having a value of 0 to the driving frequency determiner 230. When the display panel 100 is operated in always-on mode, the still image determiner 220 may output the flag signal SF having the value of 1 to the driving frequency determiner 230. In one exemplary embodiment, for example, the still image determiner 220 may generate the flag signal SF for each of the still image determining blocks SR1 to SR14.

In FIG. 5, an input vertical synchronizing signal IVS, an input data enable signal IDE and the flag signal SF in first to third frames 1F, 2F and 3F are illustrated.

As shown in FIGS. 4 and 5, the first to fifth still image determining blocks SR1 to SR5 include video images, and the sixth to fourteenth still image determining blocks SR6 to SR14 include still images, the flag signal SF has an inactive level (e.g. 0) corresponding to the first to fifth still image determining blocks SR1 to SR5 and an active level (e.g. 1) corresponding to the sixth to fourteenth still image determining blocks SR6 to SR14.

In addition, the still image determiner 220 may determine a boundary between the fifth still image determining block SR5 and the sixth still image determining block SR6 as the boundary BMS between the still image display area SR6 to SR14 and the video image display area SR1 to SR5.

Although the input image data IMG may include a single boundary BMS between the still image display area and the video image display area as shown in FIG. 4, the invention may not limited thereto. When the input image data IMG include a plurality of video image display areas spaced apart from each other, the input image data IMG may include a plurality of boundaries BMS between the still image display areas and the video image display areas.

Although the video image display area may be disposed in an upper portion of the display panel 100 and the still image display area may be disposed in a lower portion of the display panel 100, the invention may not be limited thereto. Operations in a case where the video image display area is disposed in a lower portion of the display panel 100 and the still image display area is disposed in an upper portion of the display panel 100 may be substantially the same as those of a case where the video image display area is disposed in an upper portion of the display panel 100 and the still image display area is disposed in a lower portion of the display panel 100 as described above.

In an exemplary embodiment, as shown in FIG. 6, for example, the first to seventh determining blocks SR1 to SR7 may represent video images and the eighth to fourteenth determining blocks SR8 to SR14 may represent still images.

The still image determiner 220 may generate a flag signal SF representing whether the still image determining blocks SR1 to SR14 represent the still image or the video image.

As shown in FIGS. 6 and 7, when the first to seventh still image determining blocks SR1 to SR7 include video images and the eighth to fourteenth still image determining blocks SR8 to SR14 include still images, the flag signal SF in FIG. 7 has an inactive level (e.g. 0) corresponding to the first to seventh still image determining blocks SR1 to SR7 and an active level (e.g. 1) corresponding to the eighth to fourteenth still image determining blocks SR18 to SR14.

In addition, the still image determiner 220 may determine a boundary between the seventh still image determining block SR7 and the eighth still image determining block SR8 as the boundary BMS between the still image display area SR8 to SR14 and the video image display area SR1 to SR7.

Figure 8:
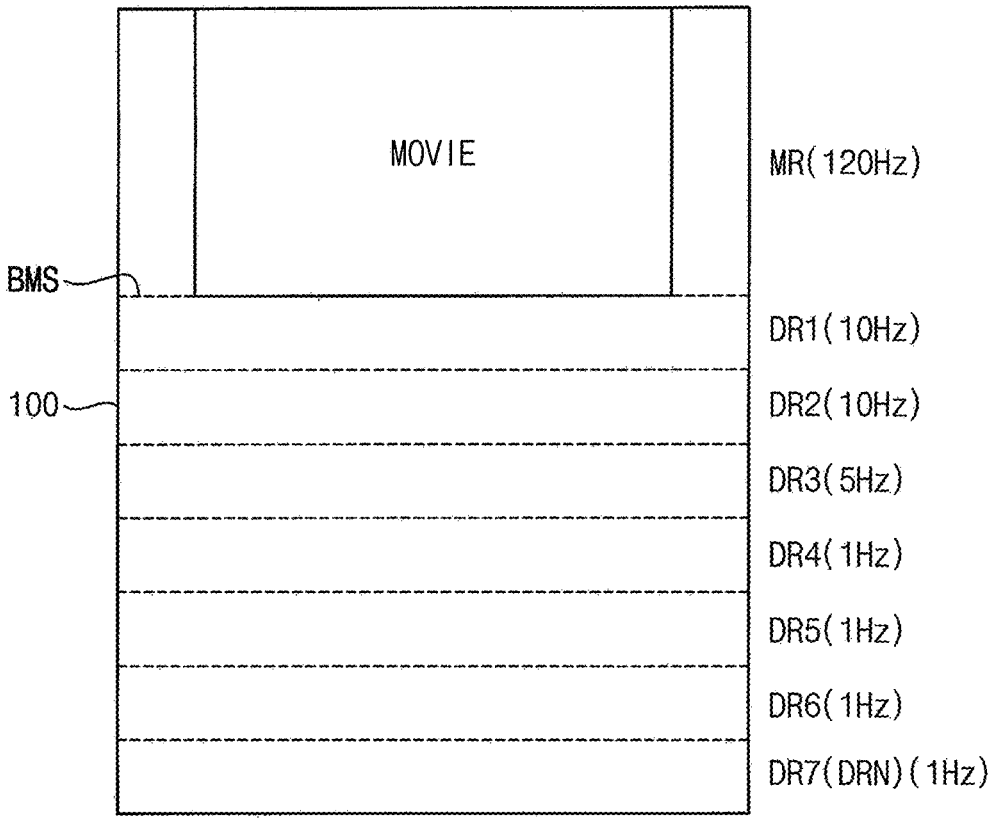
FIG. 8 is a conceptual diagram illustrating an operation of a driving frequency determiner of FIG. 2.
Figure 10:
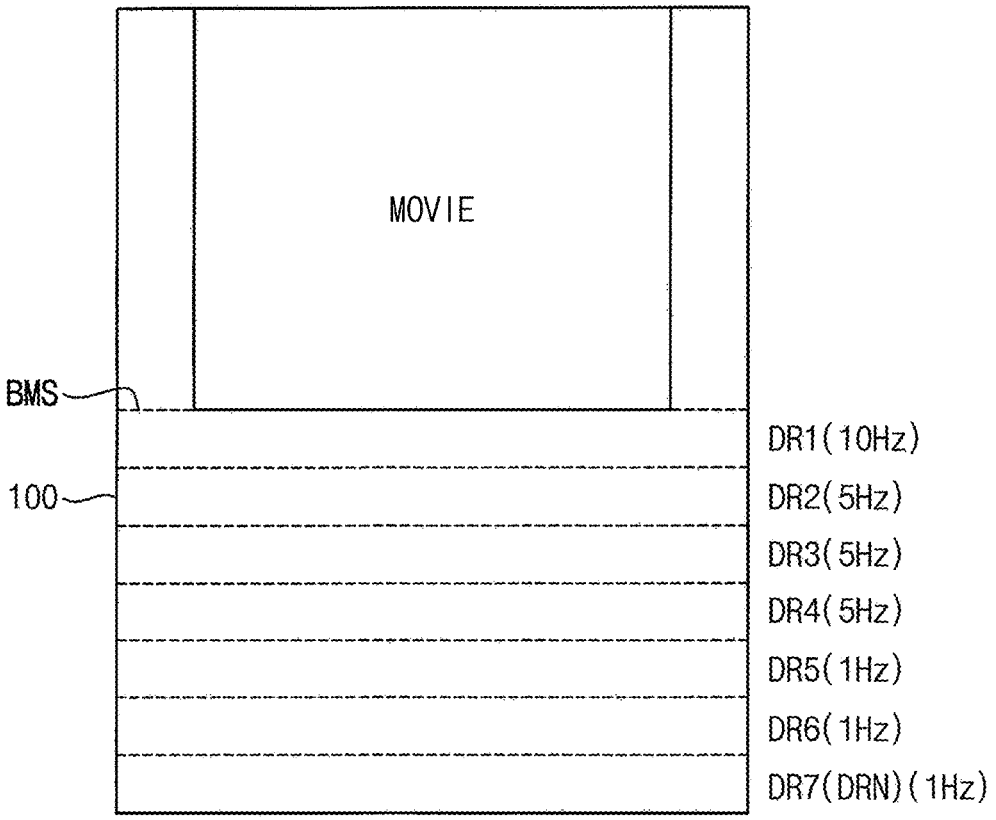
FIG. 10 is a conceptual diagram illustrating an operation of the driving frequency determiner of FIG. 2.
Figure 11:
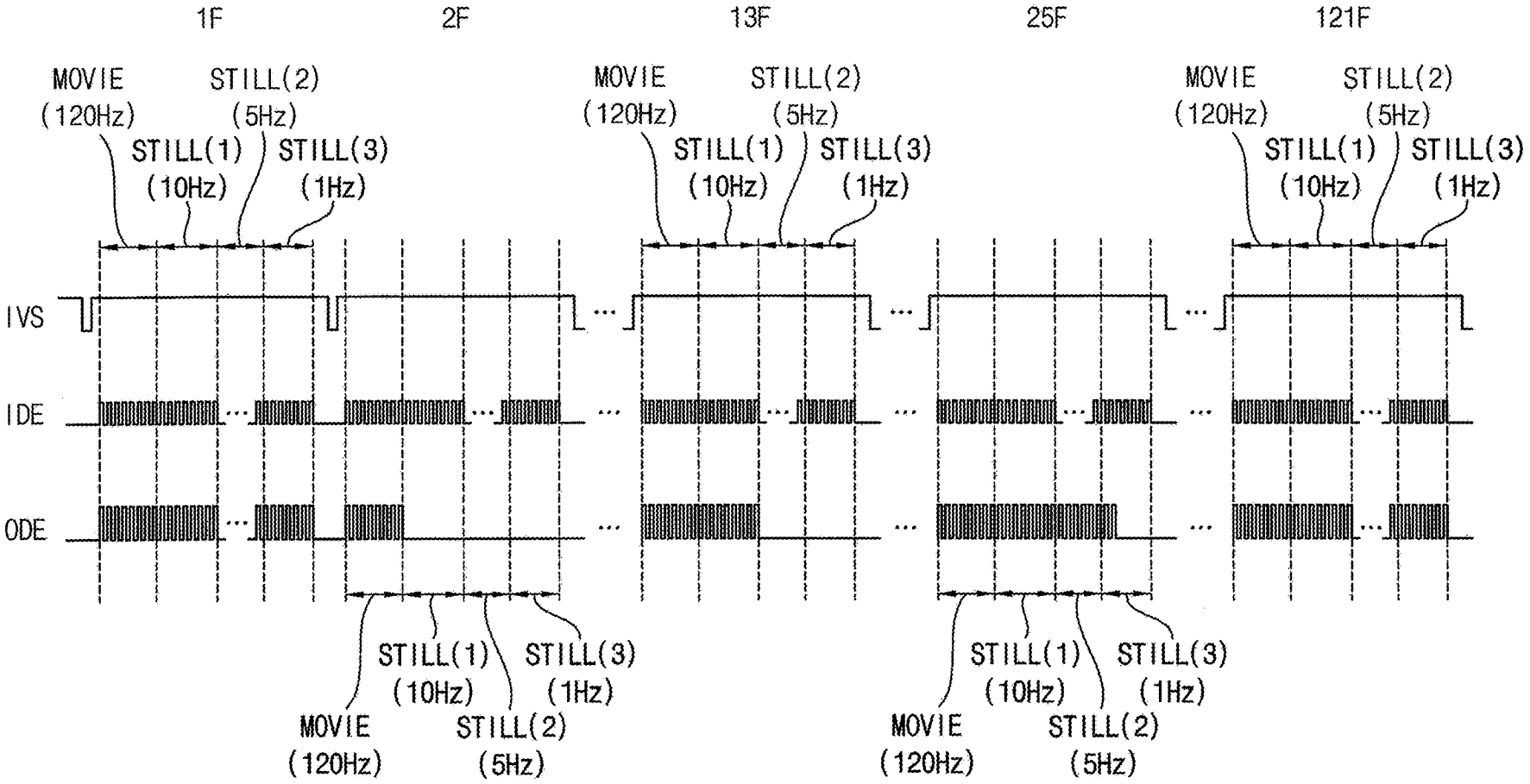
FIG. 11 is a signal timing diagram illustrating output signals of the driving frequency determiner of FIG. 2.

FIG. 8 is a conceptual diagram illustrating an operation of the driving frequency determiner 230 of FIG. 2. FIG. 9 is a table illustrating values of the flicker value storage 240 of FIG. 2. FIG. 10 is a conceptual diagram illustrating an operation of the driving frequency determiner 230 of FIG. 2. FIG. 11 is a signal timing diagram illustrating output signals of the driving frequency determiner 230 of FIG. 2.

Referring to FIGS. 1 to 11, an exemplary embodiment of the driving frequency determiner 230 may divide the still image display area into a plurality of driving frequency determining blocks DR1 to DRN and respectively determine driving frequencies RDATA1 to RDATAN of the driving frequency determining blocks DR1 to DRN based on a flicker value corresponding to a grayscale value of the input image data IMG for the driving frequency determining blocks DR1 to DRN.

A size of the still image determining block (e.g. SR1) may be different from a size of the driving frequency determining block (e.g. DR1). In one exemplary embodiment, for example, the size of the still image determining block (e.g. SR1) may be less than the size of the driving frequency determining block (e.g. DR1).

When the number of the still image determining blocks SR1 to SRM is great, a resolution for finding the boundary BMS between the still image display area and the video image display area may be great. Thus, when the size of each of the still image determining blocks SR1 to SRM decreases and the number of the still image determining blocks SR1 to SRM increases, the boundary BMS between the still image display area and the video image display area may be precisely determined so that the power consumption of the display apparatus may be further effectively reduced.

In addition, when the number of the driving frequency determining blocks DR1 to DRN is great, the still image display area may be driven in proper low driving frequencies corresponding to the flicker value.

The still image determiner 220 may determine the still image display area. The driving frequency determiner 230 may divide the still image display area into the plurality of the driving frequency determining blocks DR1 to DRN.

In one exemplary embodiment, for example, the size of the driving frequency determining blocks DR1 to DRN may be fixed independently of the size of the still image display area. In such an embodiment, where the size of the driving frequency determining blocks DR1 to DRN is fixed, the number of the driving frequency determining blocks may increase when the size of the still image display area increases according to the input image data IMG.

In one alternative exemplary embodiment, for example, the number of the driving frequency determining blocks DR1 to DRN may be fixed independently of the size of the still image display area. In such an embodiment, where the number of the driving frequency determining blocks DR1 to DRN is fixed, the size of the driving frequency determining blocks may increase when the size of the still image display area increases according to the input image data IMG. In an exemplary embodiment, as shown in FIGS. 8 to 10, the number of the driving frequency determining blocks may be fixed to seven, for example. In such an embodiment, the size of the still image display area in FIG. 10 is less than the size of the still image display area in FIG. 8 so that the size of the single driving frequency determining block in FIG. 10 is less than the size of the single driving frequency determining block in FIG. 8.

In one exemplary embodiment, for example, when the flag signal SF is 0, the driving frequency determiner 230 may drive the switching elements of the pixels in the video image display area in the normal driving frequency. In one exemplary embodiment, for example, when the flag signal SF is 0, the driving frequency determiner 230 may drive the video image display area in 120 Hz.

In one exemplary embodiment, for example, when the flag signal SF is 1, the driving frequency determiner 230 may drive the switching elements of the pixels in the still image display area in the low driving frequency. In one exemplary embodiment, for example, when the flag signal SF is 1, the driving frequency determiner 230 may drive the still image display area in a frequency between 1 Hz to 120 Hz.

The driving frequency determiner 230 may refer the flicker value storage 240 to determine the low driving frequency of the driving frequency determining blocks DR1 to DRN. The flicker value storage 240 may include a flicker value representing a degree of a flicker corresponding to a grayscale value of the input image data IMG.

The flicker value storage 240 may store the grayscale value of the input image data IMG and the flicker value corresponding to the grayscale value of the input image data IMG. The flicker value may be used for determining the driving frequency of the display panel 100. The flicker value storage 240 may be a lookup table ("LUT") type.

In FIG. 9, the input grayscale value of the input image data IMG may be 8 bits, the minimum grayscale value of the input image data IMG may be 0 and the maximum grayscale value of the input image data IMG may be 255. The number of flicker setting stages of the flicker value storage 240 may be 64. When the number of the flicker setting stages increases, the flicker may be effectively removed but a logic size of the driving controller 200 may increase. Thus, the number of the flicker setting stages may be limited.

Although the input grayscale value has an 8-bit value in FIG. 9, the invention is not limited thereto.

In FIG. 9, the number of the grayscale values of the input image data IMG is 256 and the number of the flicker setting stages is 64 so that a single flicker value in the flicker value storage 240 may correspond to four grayscale values. In one exemplary embodiment, for example, a first flicker setting stage stores the flicker value of 0 for the grayscale values of 0 to 3. In such an embodiment, the flicker value of 0 may represent the driving frequency of 1 Hz. In one exemplary embodiment, for example, a second flicker setting stage stores the flicker value of 0 for the grayscale values of 4 to 7. In such an embodiment, the flicker value of 0 may represent the driving frequency of 1 Hz. In one exemplary embodiment, for example, a third flicker setting stage stores the flicker value of 40 for the grayscale values of 8 to 11. In such an embodiment, the flicker value of 40 may represent the driving frequency of 2 Hz. In one exemplary embodiment, for example, a fourth flicker setting stage stores the flicker value of 80 for the grayscale values of 12 to 15. In such an embodiment, the flicker value of 80 may represent the driving frequency of 5 Hz. In one exemplary embodiment, for example, a fifth flicker setting stage stores the flicker value of 120 for the grayscale values of 16 to 19. In such an embodiment, the flicker value of 120 may represent the driving frequency of 10 Hz. In one exemplary embodiment, for example, a sixth flicker setting stage stores the flicker value of 160 for the grayscale values of 20 to 23. In such an embodiment, Herein the flicker value of 160 may represent the driving frequency of 30 Hz. In one exemplary embodiment, for example, a seventh flicker setting stage stores the flicker value of 200 for the grayscale values of 24 to 27. Herein the flicker value of 200 may represent the driving frequency of 60 Hz. In one exemplary embodiment, for example, a sixty second flicker setting stage stores the flicker value of 0 for the grayscale values of 244 to 247. In such an embodiment, the flicker value of 0 may represent the driving frequency of 1 Hz. In one exemplary embodiment, for example, a sixty third flicker setting stage stores the flicker value of 0 for the grayscale values of 248 to 251. In such an embodiment, the flicker value of 0 may represent the driving frequency of 1 Hz. In one exemplary embodiment, for example, a sixty fourth flicker setting stage stores the flicker value of 0 for the grayscale values of 252 to 255. In such an embodiment, the flicker value of 0 may represent the driving frequency of 1 Hz.

In one exemplary embodiment, for example, the video image display area MR in FIG. 8 may be driven in a driving frequency of 120 Hz. In one exemplary embodiment, for example, the driving frequency determiner determines the driving frequency of the first driving frequency determining block DR1 in FIG. 8 to 10 Hz based on the flicker value for the grayscale value of the input image data IMG corresponding to the first driving frequency determining block DR1 in FIG. 8. In one exemplary embodiment, for example, the driving frequency determiner determines the driving frequency of the second driving frequency determining block DR2 in FIG. 8 to 10 Hz based on the flicker value for the gray scale value of the input image data IMG corresponding to the second driving frequency determining block DR2 in FIG. 8. In one exemplary embodiment, for example, the driving frequency determiner determines the driving frequency of the third driving frequency determining block DR3 in FIG. 8 to 5 Hz based on the flicker value for the grayscale value of the input image data IMG corresponding to the third driving frequency determining block DR3 in FIG. 8. In one exemplary embodiment, for example, the driving frequency determiner determines the driving frequency of the fourth driving frequency determining block DR4 in FIG. 8 to 1 Hz based on the flicker value for the grayscale value of the input image data IMG corresponding to the fourth driving frequency determining block DR4 in FIG. 8. In one exemplary embodiment, for example, the driving frequency determiner determines the driving frequency of the fifth driving frequency determining block DR5 in FIG. 8 to 1 Hz based on the flicker value for the grayscale value of the input image data IMG corresponding to the fifth driving frequency determining block DR5 in FIG. 8. In one exemplary embodiment, for example, the driving frequency determiner determines the driving frequency of the sixth driving frequency determining block DR6 in FIG. 8 to 1 Hz based on the flicker value for the grayscale value of the input image data IMG corresponding to the sixth driving frequency determining block DR6 in FIG. 8. In one exemplary embodiment, for example, the driving frequency determiner determines the driving frequency of the seventh driving frequency determining block DR7 in FIG. 8 to 1 Hz based on the flicker value for the grayscale value of the input image data IMG corresponding to the seventh driving frequency determining block DR7 in FIG. 8.

In one exemplary embodiment, for example, the video image display area MR in FIG. 10 may be driven in a driving frequency of 120 Hz. The driving frequency of the driving frequency determining block is determined according to the grayscale value of the input image data IMG so that the driving frequency of the driving frequency determining block in FIG. 10 may be different from the driving frequency of the driving frequency determining block in FIG. 8. In one exemplary embodiment, for example, the driving frequency determiner determines the driving frequency of the first driving frequency determining block DR1 in FIG. 10 to 10 Hz based on the flicker value for the grayscale value of the input image data IMG corresponding to the first driving frequency determining block DR1 in FIG. 10. In one exemplary embodiment, for example, the driving frequency determiner determines the driving frequency of the second, third and fourth driving frequency determining blocks DR2, DR3 and DR4 in FIG. 10 to 5 Hz based on the flicker value for the grayscale value of the input image data IMG corresponding to the second, third and fourth driving frequency determining blocks DR2, DR3 and DR4 in FIG. 10. In one exemplary embodiment, for example, the driving frequency determiner determines the driving frequency of the fifth, sixth and seventh driving frequency determining blocks DR5, DR6 and DR7 in FIG. 10 to 1 Hz based on the flicker value for the grayscale value of the input image data IMG corresponding to the fifth, sixth and seventh driving frequency determining blocks DR5, DR6 and DR7 in FIG. 10.

In FIG. 11, the input vertical synchronizing signal IVS, the input data enable signal IDE and the output data enable signal ODE are illustrated. The input vertical synchronizing signal IVS and the input data enable signal IDE may be inputted to the driving controller 200 and synchronized with the input image data IMG.

The driving frequency determiner 230 may generate the output data enable signal ODE based on the driving frequencies RDATA1 to RDATAN of the driving frequency determining blocks DR1 to DRN. In an exemplary embodiment, as show in FIG. 11, the driving frequency of the video image display area MOVIE may be 120 Hz, for example, the driving frequency of a first group STILL(1) of the driving frequency determining blocks may be 10 Hz, the driving frequency of a second group STILL(2) of the driving frequency determining blocks may be 5 Hz and the driving frequency of a third group STILL(3) of the driving frequency determining blocks may be 1 Hz. In such an embodiment, as shown in FIG. 11, a second may be divided into 120 frames.

The output data enable signal ODE of the video image display area MOVIE may be the same as the input data enable signal IDE of the video image display area MOVIE. The output data enable signal ODE may be activated in first to $120^{th}$ frames corresponding to the video image display area MOVIE.

The output data enable signal ODE of the first group STILL(1) of the driving frequency determining blocks may be generated by masking a portion of the input data enable signal IDE of the first group STILL(1) of the driving frequency determining blocks. In one exemplary embodiment, for example, the output data enable signal ODE of the first group STILL(1) of the driving frequency determining blocks may be activated in every 12 frames (e.g., the $1^{st}$ frame 1F, the $13^{th}$ frame 13F, the $25^{th}$ frame 25F, . . . , $121^{st}$ frame 121F) to represent the driving frequency of 10 Hz.

The output data enable signal ODE of the second group STILL(2) of the driving frequency determining blocks may be generated by masking a portion of the input data enable signal IDE of the second group STILL(2) of the driving frequency determining blocks. In one exemplary embodiment, for example, the output data enable signal ODE of the second group STILL(2) of the driving frequency determining blocks may be activated in every 24 frames to represent the driving frequency of 5 Hz.

The output data enable signal ODE of the third group STILL(3) of the driving frequency determining blocks may be generated by masking a portion of the input data enable signal IDE of the third group STILL(3) of the driving frequency determining blocks. In one exemplary embodiment, for example, the output data enable signal ODE of the third group STILL(3) of the driving frequency determining blocks may be activated in every 120 frames to represent the driving frequency of 1 Hz.

In one exemplary embodiment, for example, a waveform of the output data enable signal ODE in $121^{st}$ to $240^{th}$ frames may be the same as the waveform of the output data enable signal ODE in first to $120^{th}$ frames.

When the driving frequency of the driving frequency determining block is changed from a first frequency to a second frequency by the driving frequency determiner 230, the compensation frame inserter 250 may insert a compensation frame between a frame of the first frequency and a frame of the second frequency.

In one exemplary embodiment, for example, the compensation frame inserter 250 may be independently operated in a unit of the driving frequency determining block. In one exemplary embodiment, for example, when the driving frequency of the first driving frequency determining block DR1 is changed from a first frequency to a second frequency, the compensation frame inserter 250 may insert a compensation frame between a frame of the first frequency and a frame of the second frequency corresponding to the first driving frequency determining block DR1. In one exemplary embodiment, for example, when the driving frequency of the second driving frequency determining block DR2 is changed from a third frequency to a fourth frequency, the compensation frame inserter 250 may insert a compensation frame between a frame of the third frequency and a frame of the fourth frequency corresponding to the second driving frequency determining block DR2.

The compensation frame inserter 250 may determine a frequency of the compensation frame and the number of the compensation frames. In one exemplary embodiment, for example, when the driving frequency of the first driving frequency determining block DR1 is changed from the first frequency to the second frequency, the frequency of the compensation frame may be determined to a value between the first frequency and the second frequency. In one exemplary embodiment, for example, when the driving frequency is changed from 60 Hz to 10 Hz, the frequency of the first compensation frame may be determined to one of 30 Hz, 20 Hz and 15 Hz. In one exemplary embodiment, for example, when the first driving frequency of the first driving frequency determining block DR1 is changed from 60 Hz to 1 Hz, the frequency of the compensation frame may be determined to one of 30 Hz, 20 Hz, 15 Hz, 10 Hz, 5 Hz and 2 Hz. The compensation frame inserter 250 may determine a plurality of the frequencies of the compensation frames.

The compensation frame inserter 250 may determine the number of the compensation frames based on difference between the first frequency and the second frequency. In one exemplary embodiment, for example, when the difference between the first frequency and the second frequency is little, the number of the compensation frames may be little. In such an embodiment, when the difference between the first frequency and the second frequency is great, the number of the compensation frames may be great.

According to an exemplary embodiment, the driving frequency is determined based on an image displayed on the display panel 100 so that a power consumption of the display apparatus may be reduced. In such an embodiment, when the input image data IMG include the still image display area and the video image display area, the still image display area and the video image display area may be driven in different frequencies so that the power consumption of the display apparatus may be further reduced.

In such an embodiment, the still image determiner 220 may divide the input image data IMG into a plurality of still image determining blocks SR1 to SRM and determine whether each of the still image determining blocks SR1 to SRM represents a still image or a video image to determine the boundary BMS between the still image display area and the video image display area so that the power consumption of the display apparatus may be further reduced.

In such an embodiment, the driving frequency determiner 230 may divide the still image display area into a plurality of driving frequency determining blocks DR1 to DRN and respectively determine driving frequencies RDATA1 to RDATAN of the driving frequency determining blocks DR1 to DRN based on the flicker value corresponding to the grayscale value of the input image data IMG so that the power consumption of the display apparatus may be further reduced, while effectively preventing a flicker.

Figure 12:
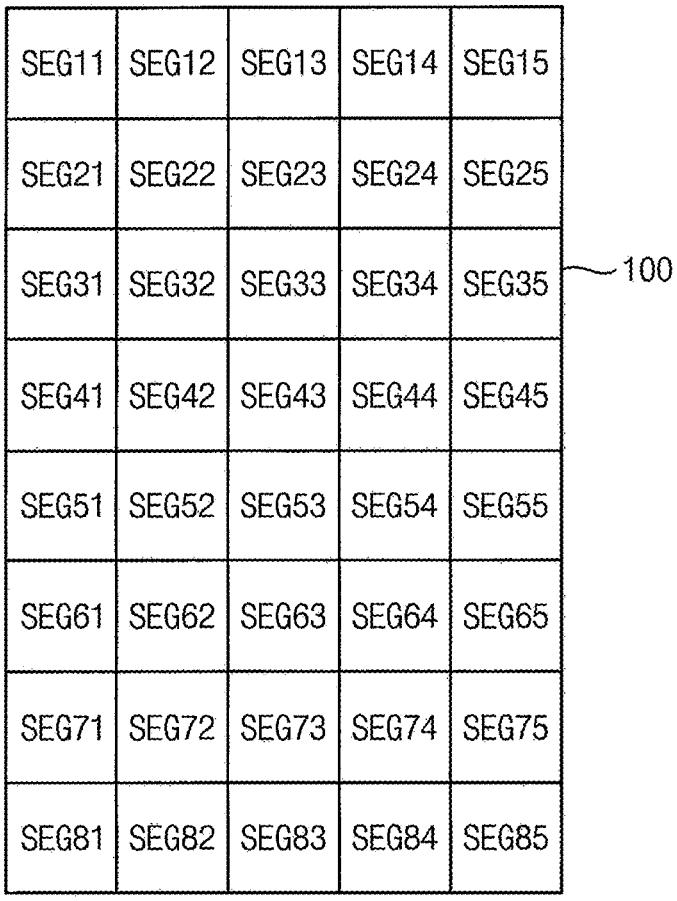
FIG. 12 is a conceptual diagram illustrating a display panel of a display apparatus according to an exemplary embodiment of the invention.
Figure 13:
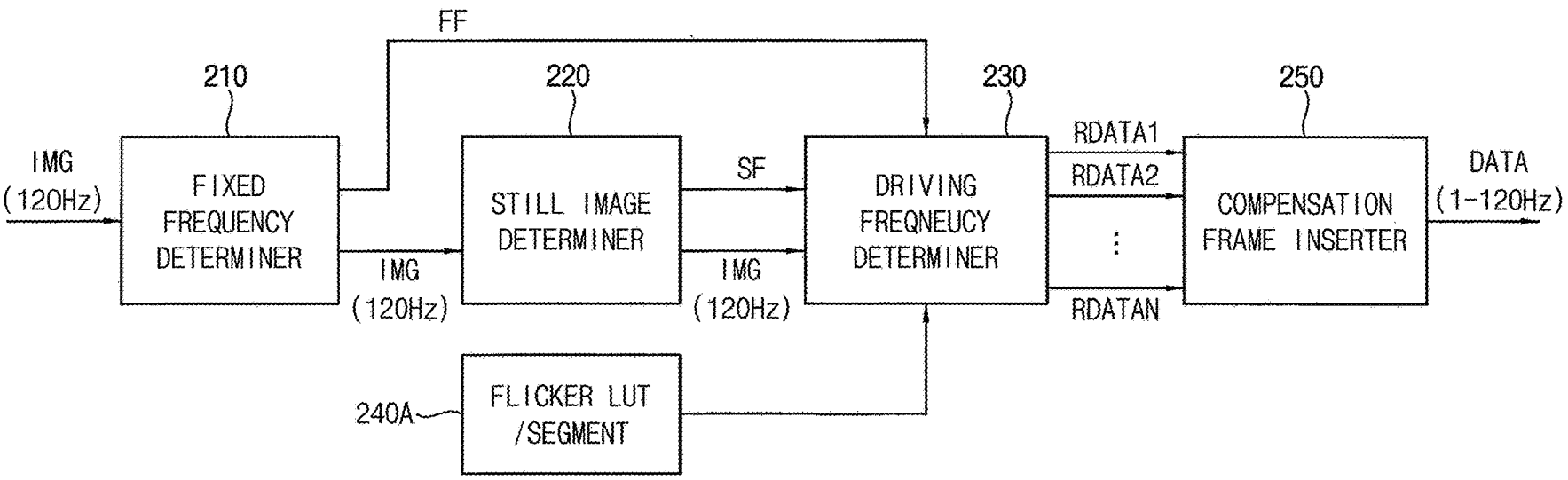
FIG. 13 is a block diagram illustrating a driving controller of the display apparatus of FIG. 12.

FIG. 12 is a conceptual diagram illustrating a display panel 100 of a display apparatus according to an exemplary embodiment of the invention. FIG. 13 is a block diagram illustrating a driving controller 200 of the display apparatus of FIG. 12.

The display apparatus and the method of driving the display panel shown in FIGS. 12 and 13 are substantially the same as the display apparatus and the method of driving the display panel described above referring to FIGS. 1 to 11 except that the display panel is divided into a plurality of segments. In FIGS. 12 and 13, the same reference numerals will be used to refer to the same or like element as those described above with reference to FIGS. 1 to 11 and any repetitive detailed description thereof will be omitted.

Referring to FIGS. 1 and 3 to 13, an exemplary embodiment of the display apparatus includes a display panel 100 and a display panel driver. The display panel driver includes a driving controller 200, a gate driver 300, a gamma reference voltage generator 400 and a data driver 500.

In such an embodiment, as shown in FIG. 13, the driving controller 200 may include a still image determiner 220, a driving frequency determiner 230 and a flicker value storage 240A. The driving controller 200 may further include the fixed frequency determiner 210. The driving controller 200 may further include a compensation frame inserter 250.

The fixed frequency determiner 210 may determine whether an input frequency of the input image data IMG has a normal type. In one exemplary embodiment, for example, the fixed frequency determiner 210 may determine whether the input frequency of the input image data IMG has the normal type by counting the number of pulses of a horizontal synchronizing signal HSYNC between a first pulse and a second pulse of a vertical synchronizing signal VSYNC or by counting the number of pulses of a data enable signal DE between the first pulse and the second pulse of the vertical synchronizing signal VSYNC.

The still image determiner 220 may divide the input image data IMG into a plurality of still image determining blocks SR1 to SRM. In one exemplary embodiment, for example, each of the still image determining blocks SR1 to SRM may extend in a direction perpendicular to a scanning direction (e.g. D2) of the gate signal. Each of the still image determining blocks SR1 to SRM may extend in the first direction D1.

The driving frequency determiner 230 may divide the still image display area into a plurality of driving frequency determining blocks DR1 to DRN and respectively determine driving frequencies RDATA1 to RDATAN of the driving frequency determining blocks DR1 to DRN based on a flicker value corresponding to a grayscale value of the input image data IMG for the driving frequency determining blocks DR1 to DRN.

The driving frequency determiner 230 may refer the flicker value storage 240A and information of the segment of the display panel 100 to determine the low driving frequency of the driving frequency determining blocks DR1 to DRN.

The display panel 100 may include a plurality of segments SEG11 to SEG85. Although an exemplary embodiment of the display panel 100 includes the segments in an eight by five matrix as shown in FIG. 12, the invention is not limited thereto. Although the segments in an eight by five matrix are illustrated in FIG. 12 for convenience of illustration and description, the actual number of the segments of the display panel 100 may be different from or substantially greater than the number of those shown in FIG. 12.

When the flicker value is determined for a unit of the pixel and only one pixel has a high flicker value, the entire display panel may be driven in a high driving frequency to prevent the flicker in the one pixel. In this case, when a flicker of only one pixel is prevented in the driving frequency of 30 Hz and the other pixels do not generate the flicker in the driving frequency of 1 Hz, the display panel 100 may be driven in the driving frequency of 30 Hz and the power consumption of the display apparatus may become higher than desired.

In an exemplary embodiment, the display panel 100 is divided into the segments and the flicker value is determined for a unit of the segment, such that the power consumption of the display apparatus may be effectively reduced.

The driving controller 200 may determine optimal driving frequencies for the segments determined based on the flicker value thereof and may determine the maximum driving frequency among the optimal driving frequencies for the segments as the low driving frequency of the display panel 100.

In an exemplary embodiment, each of the driving frequency determining blocks DR1 to SRN in FIGS. 8 and 10 may include a plurality of the segments. The driving frequency determiner 230 may determine the driving frequencies RDATA1 to RDATAN of the driving frequency determining blocks DR1 to DRN based on the optimal driving frequencies for the segments in the driving frequency determining blocks DR1 to DRN.

The driving frequency determiner 230 may generate the output data enable signal ODE based on the driving frequencies RDATA1 to RDATAN of the driving frequency determining blocks DR1 to DRN.

When the driving frequency of the driving frequency determining block is changed from a first frequency to a second frequency by the driving frequency determiner 230, the compensation frame inserter 250 may insert a compensation frame between a frame of the first frequency and a frame of the second frequency.

According to an exemplary embodiment, the driving frequency is determined according to an image to be displayed on the display panel 100 so that a power consumption of the display apparatus may be reduced. In such an embodiment, when the input image data IMG include the still image display area and the video image display area, the still image display area and the video image display area may be driven in different frequencies so that the power consumption of the display apparatus may be further reduced.

In such an embodiment, the still image determiner 220 may divide the input image data IMG into a plurality of still image determining blocks SR1 to SRM and determine whether each of the still image determining blocks SR1 to SRM represents a still image or a video image to determine the boundary BMS between the still image display area and the video image display area so that the power consumption of the display apparatus may be further reduced.

In such an embodiment, the driving frequency determiner 230 may divide the still image display area into a plurality of driving frequency determining blocks DR1 to DRN and respectively determine driving frequencies RDATA1 to RDATAN of the driving frequency determining blocks DR1 to DRN based on the flicker value corresponding to the grayscale value of the input image data IMG so that the power consumption of the display apparatus may be further reduced.

According to the invention as explained above, the power consumption of the display apparatus may be reduced and the display quality of the display panel may be enhanced.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display apparatus comprising:

a display panel comprising a gate line, a data line and a pixel, wherein the display panel displays an image based on input image data;

a gate driver which outputs a gate signal to the gate line;

a data driver which outputs a data voltage to the data line; and a driving controller which controls an operation of the gate driver and an operation of the data driver and drive a still image display area and a video image display area of a display area of the display panel in different driving frequencies, wherein the driving controller comprises a still image determiner which divides the input image data into a plurality of still image determining blocks, respectively determines whether the still image determining blocks represent a still image or a video image and determines a boundary between the still image display area and the video image display area, and wherein each of the still image determining blocks extends in an extending direction of the gate signal.

2. The display apparatus of claim 1, wherein the still image determiner is which generates a flag signal representing whether the still image determining blocks represent the still image or the video image.

3. The display apparatus of claim 1, wherein the driving controller further comprises a driving frequency determiner which divides the still image display area into a plurality of driving frequency determining blocks and respectively determines driving frequencies of the driving frequency determining blocks based on a flicker value corresponding to a grayscale value of the input image data for the driving frequency determining blocks.

4. The display apparatus of claim 3, wherein a size of the still image determining block is different from a size of the driving frequency determining block.

5. The display apparatus of claim 4, wherein the size of the still image determining block is less than the size of the driving frequency determining block.

6. The display apparatus of claim 3, wherein a size of the driving frequency determining block is fixed independently of a size of the still image display area, and when the size of the still image display area increases according to the input image data, a number of the driving frequency determining blocks increases.

7. The display apparatus of claim 3, wherein a number of the driving frequency determining blocks is fixed independently of a size of the still image display area, and when the size of the still image display area increases according to the input image data, a size of the driving frequency determining block increases.

8. The display apparatus of claim 3, wherein the driving controller further comprises a fixed frequency determiner which determines whether an input frequency of the input image data has a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

9. The display apparatus of claim 8, wherein the fixed frequency determiner generates a frequency flag representing whether the input frequency of the input image data has the normal type or not, and the driving frequency determiner determines a driving frequency of the display panel.

10. The display apparatus of claim 3, wherein the driving controller further comprises a compensation frame inserter which inserts a compensation frame between a frame of a first frequency and a frame of a second frequency when the driving frequencies of the driving frequency determining blocks are changed from the first frequency to the second frequency by the driving frequency determiner.

11. The display apparatus of claim 3, wherein the display panel comprises a plurality of segments, and the driving controller determines a driving frequency of the display panel based on driving frequencies determined based on a flicker value corresponding to a grayscale value of the input image data for the segments.

12. The display apparatus of claim 11, wherein each of the driving frequency determining blocks includes a plurality of the segments, and the driving frequency determiner determines the driving frequency of each of the driving frequency determining blocks based on driving frequencies determined based on the flicker value corresponding to the grayscale value of the input image data for the segments therein.

13. A method of driving a display panel, the method comprising:

dividing input image data into a plurality of still image determining blocks;

respectively determining whether the still image determining blocks represent a still image or a video image;

determining a boundary between a still image display area and a video image display area of a display area of the display panel;

determining a driving frequency of the still image display area;

determining a driving frequency of the video image display area;

outputting a gate signal to a gate line of the display panel based on the driving frequency of the still image display area and the driving frequency of the video image display area; and outputting a data voltage to a data line of the display panel based on the driving frequency of the still image display area and the driving frequency of the video image display area, wherein the still image display area and the video image display area of the display area are driven in different driving frequencies from each other, and wherein each of the still image determining blocks extends in an extending direction of the gate signal.

14. The method of claim 13, further comprising:

generating a flag signal representing whether the still image determining blocks represent the still image or the video image.

15. The method of claim 13, further comprising:

dividing the still image display area into a plurality of driving frequency determining blocks; and respectively determining driving frequencies of the driving frequency determining blocks based on a flicker value corresponding to a grayscale value of the input image data for the driving frequency determining blocks.

16. The method claim 15, wherein a size of the still image determining block is less than a size of the driving frequency determining block.

17. The method of claim 15, further comprising:

inserting a compensation frame between a frame of a first frequency and a frame of a second frequency when the driving frequencies of the driving frequency determining blocks are changed from the first frequency to the second frequency.

18. The method of claim 15, wherein each of the driving frequency determining blocks includes a plurality of segments, and the driving frequency of each of the driving frequency determining blocks is determined based on driving frequencies for determined based on the flicker value corresponding to the grayscale value of the input image data for the segments therein.

19. The method of claim 13, further comprising:

determining whether an input frequency of the input image data is a normal type by counting a number of pulses of a horizontal synchronizing signal between a first pulse and a second pulse of a vertical synchronizing signal or by counting a number of pulses of a data enable signal between the first pulse and the second pulse of the vertical synchronizing signal.

20. The method of claim 19, further comprising:

generating a frequency flag representing whether the input frequency of the input image data has the normal type or not, wherein the driving frequency of the still image display area is determined based on the frequency flag.

* * * * *